US012012299B2

(12) United States Patent
Morelli et al.

(10) Patent No.: US 12,012,299 B2
(45) Date of Patent: Jun. 18, 2024

(54) DEVICE FOR REPLACING A REEL IN AN UNWINDER AND RELATED METHOD

(71) Applicant: FABIO PERINI S.P.A., Lucca (IT)

(72) Inventors: Roberto Morelli, S. Maria a Colle (IT); Andrea Petrone, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 407 days.

(21) Appl. No.: 17/436,184

(22) PCT Filed: Mar. 3, 2020

(86) PCT No.: PCT/EP2020/055529
§ 371 (c)(1),
(2) Date: Sep. 3, 2021

(87) PCT Pub. No.: WO2020/178278
PCT Pub. Date: Sep. 10, 2020

(65) Prior Publication Data

US 2022/0127094 A1 Apr. 28, 2022

(30) Foreign Application Priority Data

Mar. 6, 2019 (IT) ..... 102019000003205

(51) Int. Cl.
*B65H 19/18* (2006.01)
*B65H 19/10* (2006.01)
*B65H 19/12* (2006.01)

(52) U.S. Cl.
CPC ..... *B65H 19/1852* (2013.01); *B65H 19/102* (2013.01); *B65H 19/126* (2013.01);
(Continued)

(58) Field of Classification Search
CPC ..... B65H 19/02; B65H 19/102; B65H 2301/46115
See application file for complete search history.

(56) References Cited

U.S. PATENT DOCUMENTS 5,487,805 A * 1/1996 Boriani ..... B65H 19/1852 156/509
5,620,554 A * 4/1997 Venable ..... B65H 39/16 156/499

(Continued)

FOREIGN PATENT DOCUMENTS

EP 0766641 B1 9/1999
EP 1013583 A2 6/2000

(Continued)

*Primary Examiner* — William A. Rivera
(74) *Attorney, Agent, or Firm* — Breiner & Breiner, L.L.C.

(57) ABSTRACT

The unwinder includes an unwinding station, in which to arrange a reel to be unwound. In the unwinding station there is arranged a series of guide rollers, defining a feed path of the web material. There are also provided: a cutting member adapted to cut a web material coming from an exhausted reel; and splicing members to splice a trailing edge of a first web material coming from an exhausted reel to a leading edge of a second web material coming from a new reel. A pick-up device is configured to pick up the leading edge of the second web material from a temporary retaining element, carried by a transfer unit to transfer reels to the unwinding station.

35 Claims, 8 Drawing Sheets

(52) U.S. Cl.
CPC ..... *B65H 2301/41732* (2013.01); *B65H 2301/46115* (2013.01)

(56) References Cited

U.S. PATENT DOCUMENTS

| | | | | | |
|---|---|---|---|---|---|
| 5,692,698 | A * | 12/1997 | Forbes | B65H 37/002 | 242/559.2 |
| 5,975,457 | A * | 11/1999 | Forbes | B65H 19/1873 | 242/555.2 |
| 6,325,324 | B1 * | 12/2001 | Getz | B65H 19/1873 | 242/555.2 |
| 6,451,145 | B1 * | 9/2002 | Forbes | B65H 19/1836 | 156/507 |
| 6,955,320 | B2 * | 10/2005 | Martinez | B65H 19/126 | 242/555.2 |
| 10,994,959 | B2 * | 5/2021 | Picchi | B65H 19/20 | |
| 2006/0175457 | A1 * | 8/2006 | Benvenuti | B65H 19/126 | 242/555 |
| 2007/0228206 | A1 * | 10/2007 | Matzenmuller | B65H 19/1852 | 242/556 |
| 2010/0264248 | A1 * | 10/2010 | Butterworth | B65H 19/1847 | 242/554 |
| 2015/0034758 | A1 * | 2/2015 | Acciari | B65H 23/1825 | 242/555.4 |

FOREIGN PATENT DOCUMENTS

| | | | |
|---|---|---|---|
| EP | 1601601 | B1 | 3/2007 |
| EP | 1601600 | B1 | 2/2010 |
| EP | 1742860 | B1 | 8/2011 |
| EP | 2782857 | B1 | 1/2017 |
| EP | 3197803 | B1 | 8/2018 |
| GB | 1474781 | | 5/1977 |
| JP | S59-19029 | A | 1/1984 |
| JP | H04-153152 | A | 5/1992 |
| WO | 2006077608 | A2 | 7/2006 |

* cited by examiner

DEVICE FOR REPLACING A REEL IN AN UNWINDER AND RELATED METHOD

TECHNICAL FIELD

The present invention relates to converting machinery for web materials, in particular paper. More particularly, embodiments described herein concern unwinders for reels of web material, for example in particular paper, and specifically tissue paper.

BACKGROUND ART

In the field of converting of continuous web materials, in particular in the field of converting of tissue paper, nonwovens and similar products, it is known to feed a converting line with one or more plies of continuous web material, fed from one or more large reels, also called parent reels. The plies are converted into finished or semi-finished products, such as rolls of tissue paper, destined for consumption.

The converting lines operate continuously until the reel or reels are exhausted. Feed of the converting line is interrupted when an exhausted reel must be replaced with a new reel. To avoid line stoppages, solutions have been studied in which flying reel changes take place, without interrupting the feed of web material to the converting line, but if necessary, slowing it down. Unwinders in which flying change of the exhausted reel takes place, for example disclosed in EP1742860, EP1601601, EP1601600, WO2006/077608, EP2782857, EP0766641, are costly and complex. More particularly, EP0766641 discloses an automatic unwinder in which the parent reels are carried by carriages provided with a system for retaining the leading edge of a new parent reel that interfaces with an automatic exchange system. This system is very efficient but has the disadvantage of requiring costly transport carriages and complicated suction systems that need constant maintenance.

EP3197803 discloses a parent reel unwinder provided with a complex system for moving reels which comprises a lifting arm integrated in the unwinder, adapted to automatically replace the exhausted parent reels with new parent reels. This system also comprises expandable tailstocks for engaging the parent reels, but does not comprise a system for facilitating reel exchange.

Therefore, it would be useful and advantageous to provide a system that enables a reduction in the downtimes of the line with limited costs and reduced technical complexity, without having recourse to unwinders that provide for a flying change or complex exchange systems.

SUMMARY OF THE INVENTION

According to a first aspect, an unwinder for unwinding reels of web material to be fed to a converting line is described, comprising an unwinding station, in which to arrange a reel to be unwound. In the unwinding station a series of guide rollers are arranged, defining a feed path of the web material. Also provided is a cutting member adapted to cut a web material coming from an exhausted reel. The unwinder further comprises splicing members for splicing a trailing edge of a first web material coming from an exhausted reel to a leading edge of a second web material coming from a new reel. A pick-up device is adapted to pick up the leading edge of the second web material from a temporary retaining element, carried by a unit to transfer reels to the unwinding station.

According to another aspect, a method is described for replacing a first reel onto which a first web material is wound in an unwinder, with a second reel onto which a second web material is wound, comprising the following steps:

- hooking the second reel to a transfer unit;
- engaging a leading edge of the second web material to a pick-up device carried by the transfer unit;
- severing the first web material by means of a cutting member, forming a trailing edge of the web material upstream of a portion of the first web material that remains in a feed path;
- transferring the second reel by means of the transfer unit into an unwinding position of the unwinder;
- by means of the pick-up device arranged in the unwinder, engaging the leading edge of the second web material, separating it from the pick-up device and inserting it into a feed path.

Further features and embodiments of the method and of the device are illustrated hereunder and set forth in the appended claims, which form an integral part of the present description.

BRIEF DESCRIPTION OF THE DRAWINGS

The invention will be better understood by following the description and the accompanying drawings, which illustrate an exemplifying and non-limiting embodiment of the invention. More particularly, in the drawings.

DETAILED DESCRIPTION

Figure 1:
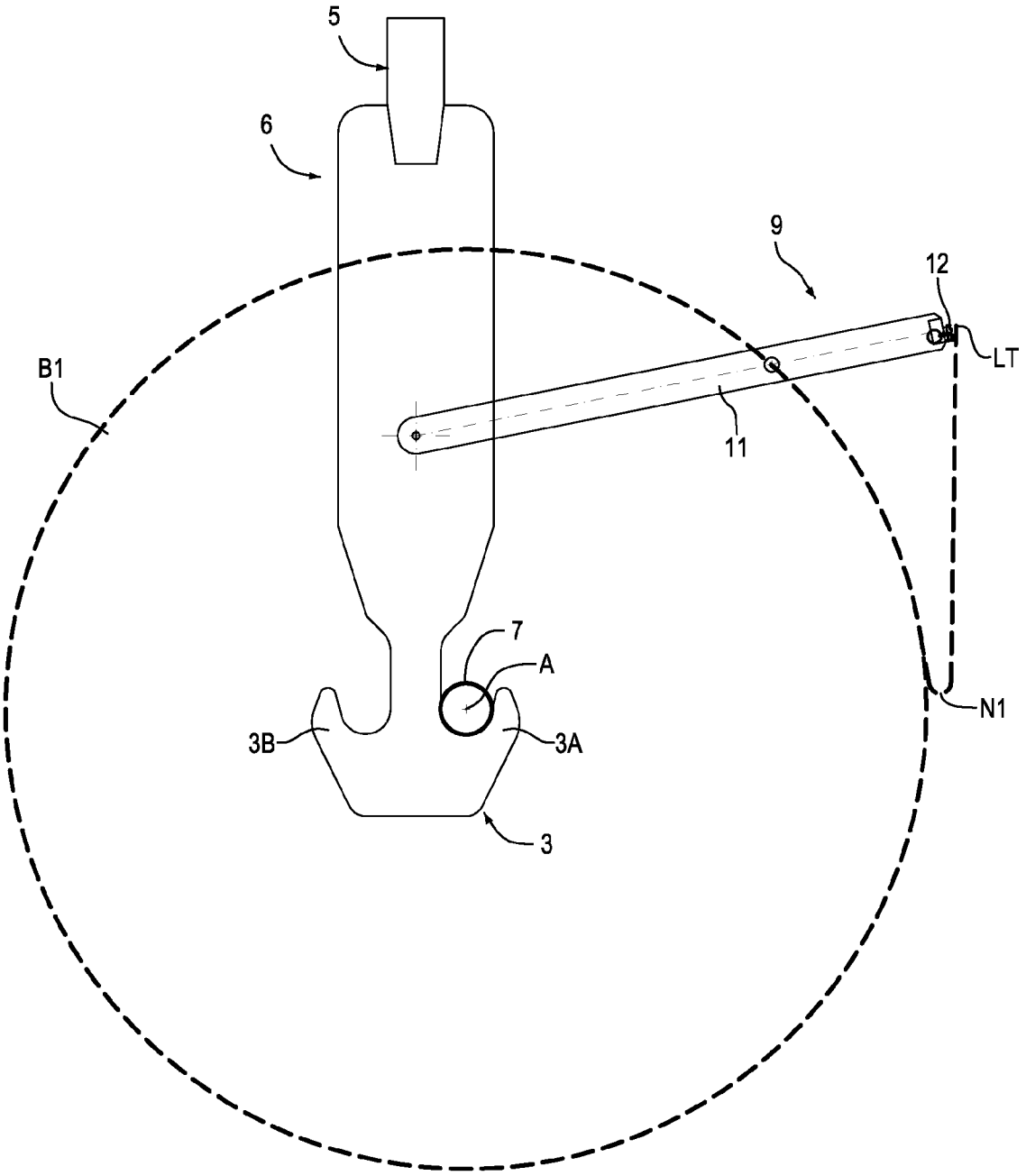
FIG. 1 is a schematic side view of the step of preparing a leading edge of a new reel ready to replace an exhausted reel in an unwinder.

FIG. 1 shows a side view of a reel B1 of web material N1, ready to replace an exhausted reel B0 (FIG. 2) in an unwinder 1. The reel B1 is supported on a pair of hooks 3, only one of which is visible in FIG. 1, the other being identical and aligned with the first along the direction of the axis A of the reel B1. The hooks 3 are part of a transfer unit indicated as a whole with 6. The transfer unit 6 can advantageously comprise an aerial transfer member, i.e. suspended from a load-bearing structure so that it does not require to rest on the ground. In some embodiments, the transfer unit can comprise a bridge crane 5 or be suspended therefrom.

In some embodiments, each hook 3 is double and has two substantially symmetrical seats 3A, 3B, with which to engage two pins placed at the end of a core 7 of a parent reel about which the web material N is wound in turns. The core 7 can be made of cardboard, plastic or other suitable materials. The double and symmetrical configuration of the hooks 3 is functional to a more rapid handling of the reels in the unwinder 1, as will be clarified below.

Associated with the transfer unit 6 is a temporary retaining element of the leading edge LT of the reel B1 supported by the hooks 3. In the embodiment illustrated, the temporary retaining element, indicated as a whole with 9, comprises a pair of arms 11 and a cross member 12 which extends between the arms 11 (only one of which is visible in the drawings) according to a direction parallel to the axis A of the reel B1 engaged by the hooks 3.

The leading edge LT can be retained on the cross member 12 of the temporary retaining element by any means, for example a mechanical means, such as a series of needles, or a series of elastic elements, or adhesives, or any other suitable mechanism.

Figure 2:
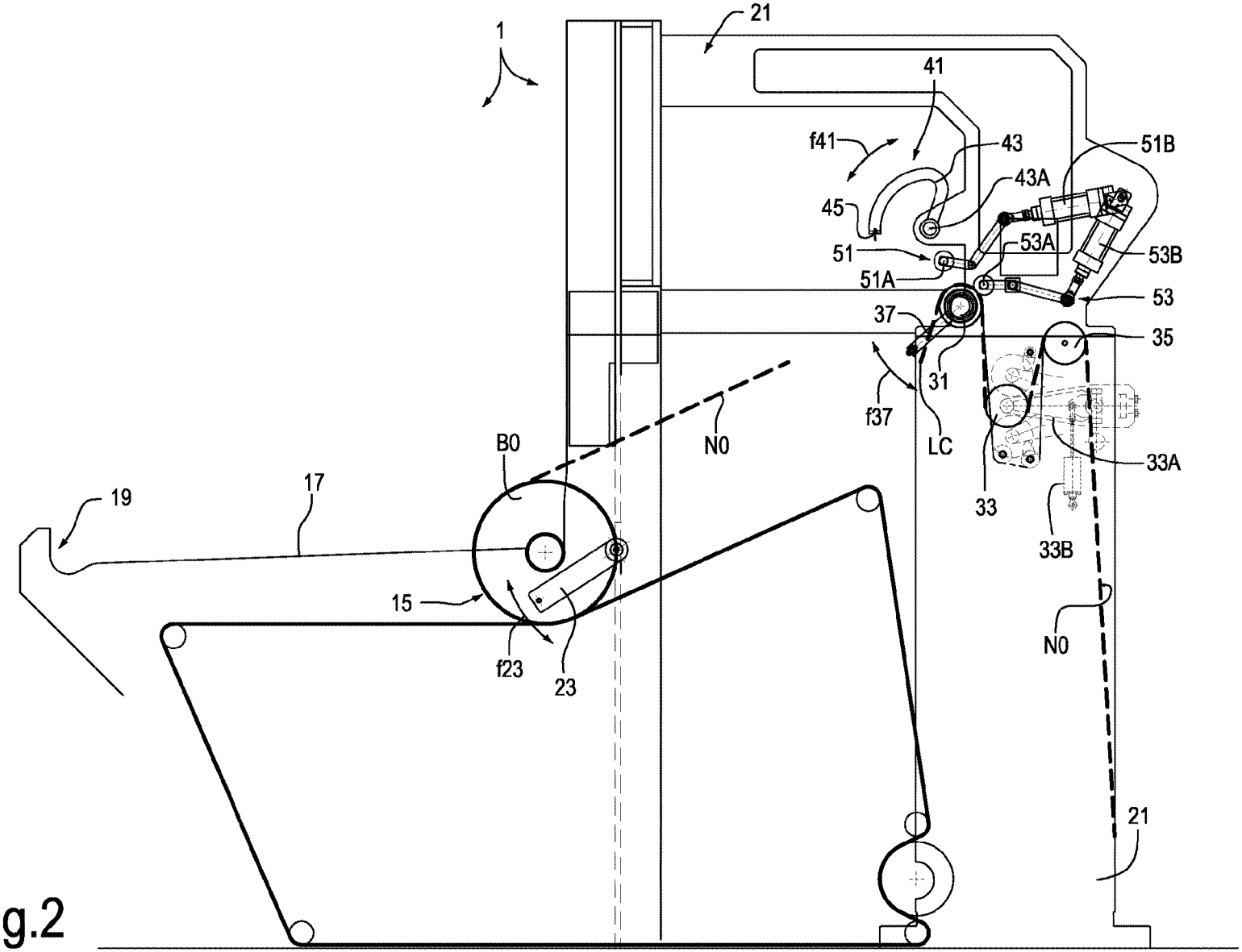
FIGS. 2 to 7 are four steps of a cycle for replacing an exhausted reel with a new reel in a side view of an unwinder.
Figure 2A:
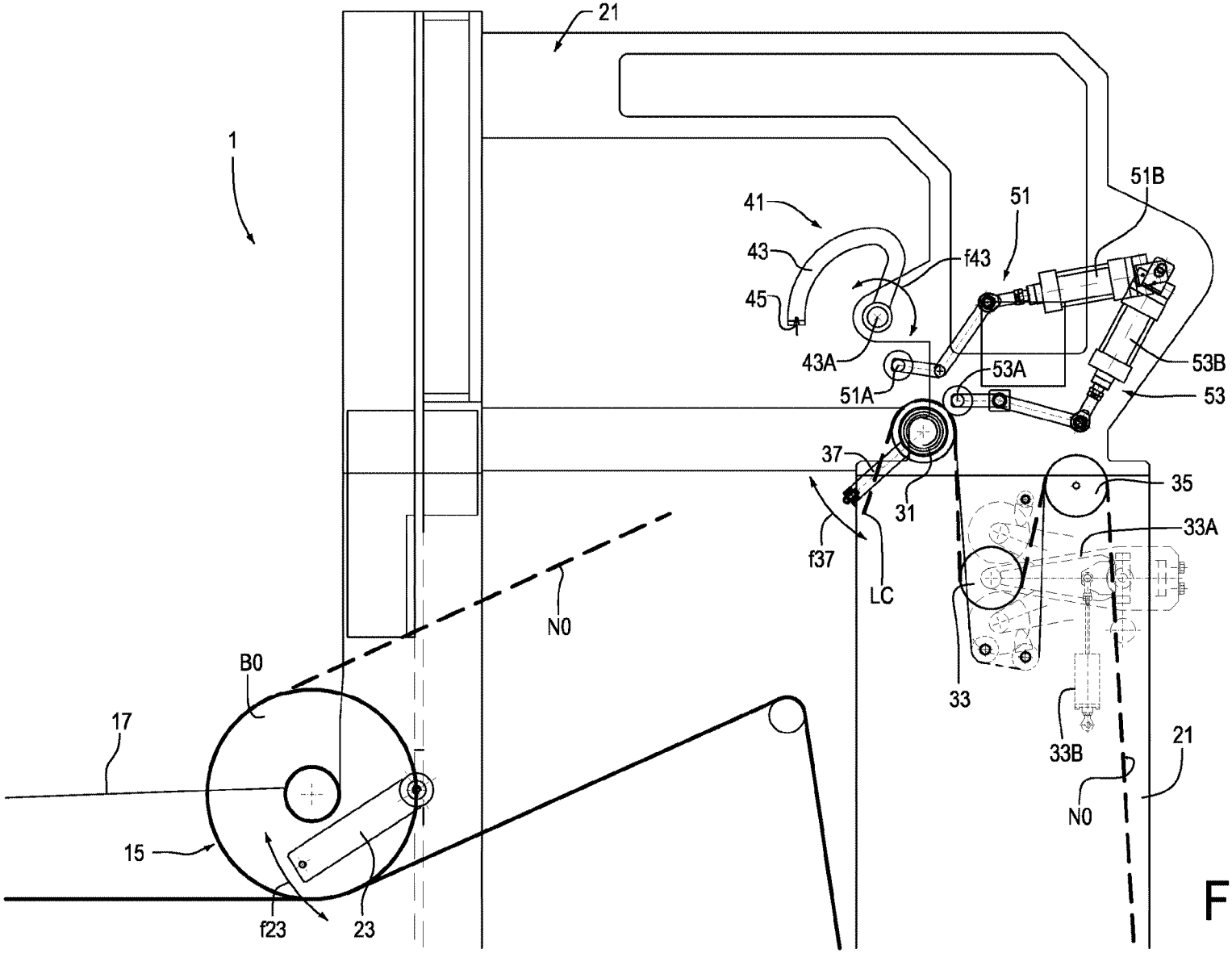
FIG. 2A is an enlarged view of FIG. 2.

With reference to FIGS. 2 and 2A, the unwinder 1 comprises an unwinding station 15, positioned in which is a reel to be unwound to dispense the web material wound thereon to a converting line downstream, not shown. Unwinding of the web material N can be obtained by rotating the parent reel with a peripheral rotation system. This can have belts that partially surround the side surface of the reel and which are guided about pulleys, at least one of which is motorized. An unwinding system of this type is indicated schematically in the accompanying figures. Alternatively, the parent reel can be rotated with other known systems, such as centrally driven systems with motorized tailstocks, which transmit a torque directly to the core 7 of the parent reel. In other embodiments, not shown, both unwinding systems, i.e., a peripheral system with belts and a central system with motorized tailstocks, can be provided. In FIG. 2 a reel B0 that is nearly exhausted, which must be replaced with the reel B1 prepared on the transfer unit 6, is placed in the unwinding station 15. From the unwinding station 15 there extends a guide 17 that terminates in a dwell and removal station 19, in which an exhausted reel is positioned for subsequent removal. The exhausted reel can comprise a series of turns of residual web material wound about the winding core 7. In some cases, the exhausted reel can also comprise the winding core 7 only.

The unwinder 1 comprises a series of members, associated with the unwinding station 15, for quick replacement of the reel B0 with the reel B1. These members can be supported by a stationary structure 21.

More particularly, the members associated with the stationary structure 21 of the unwinder 1 comprise an ejector 23, configured to eject an exhausted reel from the unwinding station 15. The ejector 23 is movable according to the double arrow f23 (see FIG. 2), by means of an actuator, not shown, for example a hydraulic or pneumatic piston-cylinder actuator, an electric motor or any other suitable actuator. By means of the rotation movement of the ejector 23, an exhausted reel B0 can be pushed from a seat provided in the unwinding station 15 onto the guide 17 to be transferred to the dwell station 19.

In practice, the ejector 23 can comprise a pair of pivoting arms placed on the two lateral side elements of the unwinder 1, to act on the pins engaged on opposite ends of a winding core 7 of the exhausted reel B0 to be ejected and replaced.

Associated with the stationary structure 21 is an assembly of guide rollers 31, 33, 35 to define a feed path of the web material N unwound from a reel located in the unwinder 1. In the illustrated embodiment, the rollers 31 and 35 have a fixed axis, while the roller 33 is carried by oscillating arms 33A on which an actuator 33B or a pair of actuators acts, which control pivoting of the arms 33A, for example to maintain a constant tension in the web material N during unwinding.

Reference number 37 indicates a cutting device or member carried by the structure 21. The cutting device or member 37 is adapted to cut the end of a web material coming from a reel that is nearly exhausted, to form a trailing edge of the web material N, to be spliced to the leading edge of a web material coming from a new reel, as described in greater detail below. The cutting device 37 can, for example, comprise a blade extending parallel to the axis of the reel B0 that is in the unwinder 1 and supported by a pair of arms pivoting according to the double arrow f37 under the control of an actuator, not shown, such as an electric motor, a piston-cylinder actuator, or another suitable actuator. In the illustrated embodiment, by way of example the cutting device 37 is pivoting about an axis coincident with the axis of the roller 31.

Associated with the stationary structure 21 is a pick-up device 41, adapted to pick up the leading edge of the web material N of a reel B1 arranged to replace an exhausted reel B0. The pick-up device 41 can have a pair of arms 43, only one of which is visible in the drawing, hinged about an axis 43A parallel to the axis of the guide rollers 31, 33, 35. The pivoting movement about the axis 43A, indicated with the double arrow f41, can be imparted by a suitable actuator, not shown, such as an electric motor, a piston-cylinder actuator, or another suitable actuator. The arms 43 have an arched shape for reasons that will be clear below from the description of an operating cycle. In the illustrated embodiment, the arms 43 of the pick-up device 41 carry a pick-up member parallel to the rotation axis 43A, adapted to engage the leading edge of the web material of a reel B1 to replace the exhausted reel B0 located in the unwinder 1.

The unwinder 1 further comprises splicing members for splicing the trailing edge of the web material of a reel B0 that is nearly exhausted to the leading edge of a web material of a new reel. In some embodiments the splicing members can comprise simple pressing means that splice the two edges by means of a double-sided adhesive tape previously applied to the leading edge of the new reel, for example. In other embodiments, as illustrated in the accompanying drawing, the splicing members can be configured as mechanical splicing, i.e. mechanical ply-bonding, members, which splice the two edges, leading and trailing, exerting a localized pressure on the two superimposed edges.

In the embodiment illustrated in the drawings, the splicing members comprise a first pressing member and a second pressing member, co-acting with one of the guide rollers of the web material, for example the roller 31, i.e., the roller farthest upstream along the feed path of the web material.

In practical embodiments, the first pressing member and the second pressing member are staggered with respect to one another along the feed path of the web material. In the accompanying figures, the second pressing member is indicated with 51 and the first pressing member, located downstream of the second pressing member 51 with respect to the direction of feed of the web material, is indicated with 53.

The second pressing member 51 can comprise a plurality of ply-bonding wheels 51A co-acting with the first guide roller 31. In the accompanying figures, a single ply-bonding wheel 51A is visible, but in practice the first splicing member 51 comprises a plurality of ply-bonding wheels 51A coaxial with one another and spaced along the axis of the roller 31. The ply-bonding wheels 51A of the second pressing member 51 can be pressed against the roller 31 by one or more actuators 51B, for example piston-cylinder actuators.

The first pressing member 53 can comprise a plurality of ply-bonding wheels 53A co-acting with the first guide roller 31. In the accompanying figures a single ply-bonding wheel 53A is visible, but in practice the second splicing member 53 comprises a plurality of ply-bonding wheels 53A coaxial with one another and spaced along the axis of the roller 31. The ply-bonding wheels 53A of the first pressing member 53 can be pressed against the roller 31 by one or more actuators 53B, for example piston-cylinder actuators.

The operation of the device described above is illustrated hereunder with reference to the sequence of FIGS. 2 to 7.

FIG. 2 shows an exhausted reel B0, which must be replaced. Reference N0 indicates the web material of the exhausted reel B0. Reference LC indicates the trailing edge that has been formed by severing the web material N0 by means of the cutting device.

Figure 3:
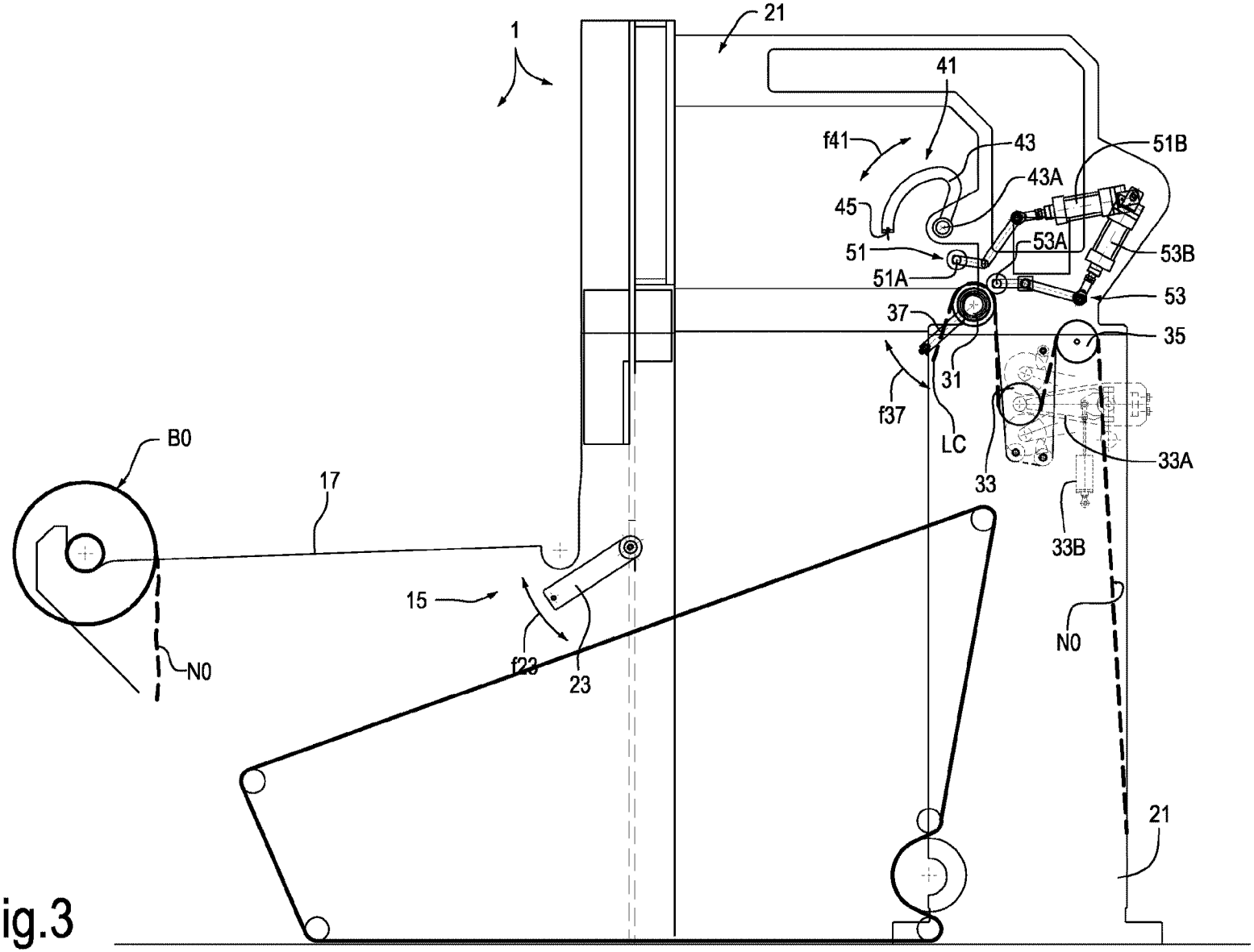

In FIG. 3 the exhausted reel B0 has been ejected by means of a movement according to f23 of the ejector 23 and is in the dwell station 19, so that the unwinding station 15 is free to receive a new reel B1 prepared on the transfer unit 6.

Figure 4:
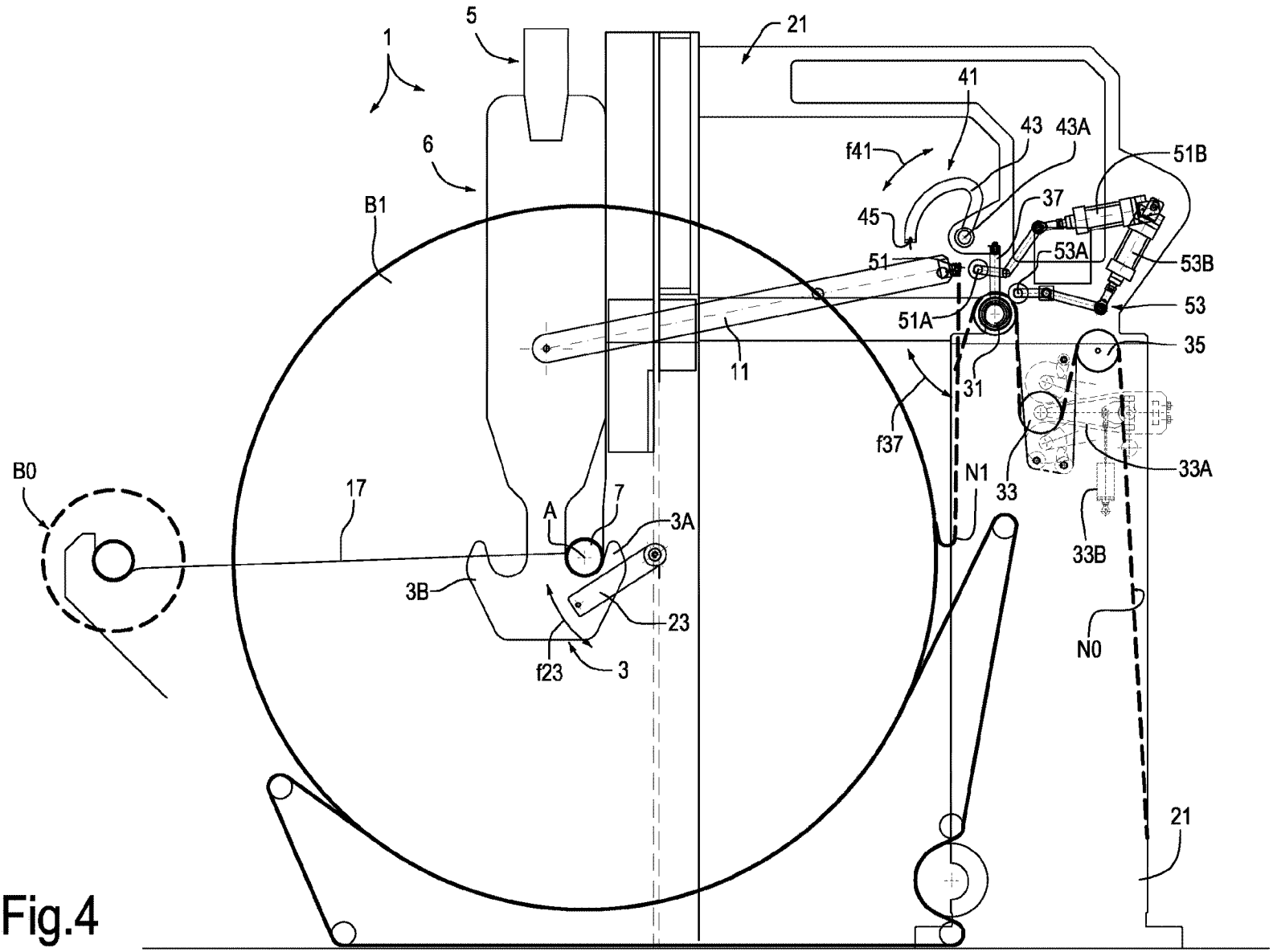

In FIG. 4 the new reel B1 has been unloaded from the transfer unit 6 into the unwinding station 15. The leading edge LT of the web material N1 of the reel B1 is engaged with the temporary retaining element 9. The arched arms 43 are in a raised position. The trailing edge LC of the web material N0 of the previous reel B0 is retained by the ply-bonding wheels 53A of the first pressing member 53 against the guide roller 31.

Figure 5:
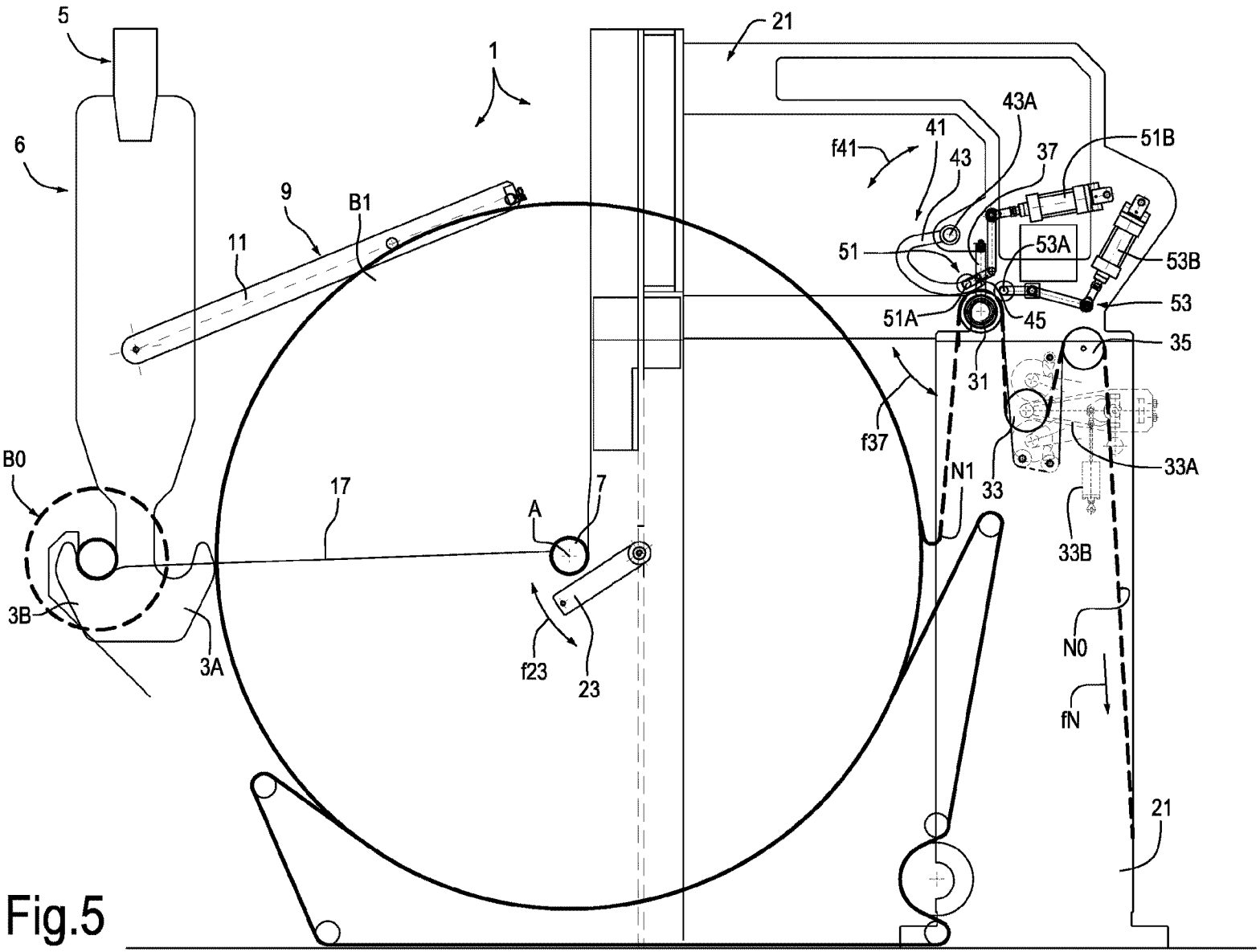

In FIG. 5 the pair of arched arms 43 of the pick-up device 41 have been rotated clockwise so as to engage the leading edge LT of the web material N1 and remove it from the temporary retaining element 9. With the rotation movement of the arms 43, these latter transfer the leading edge LT between the roller 31 and the series of ply-bonding wheels 51A, as can be seen in FIG. 5. In this step, the ply-bonding wheels 51A are held at a distance from the roller 31 to enable insertion of the leading edge LT. The arched form of the arms 43 enables these latter to pass around the temporary retaining element 9.

Figure 6:
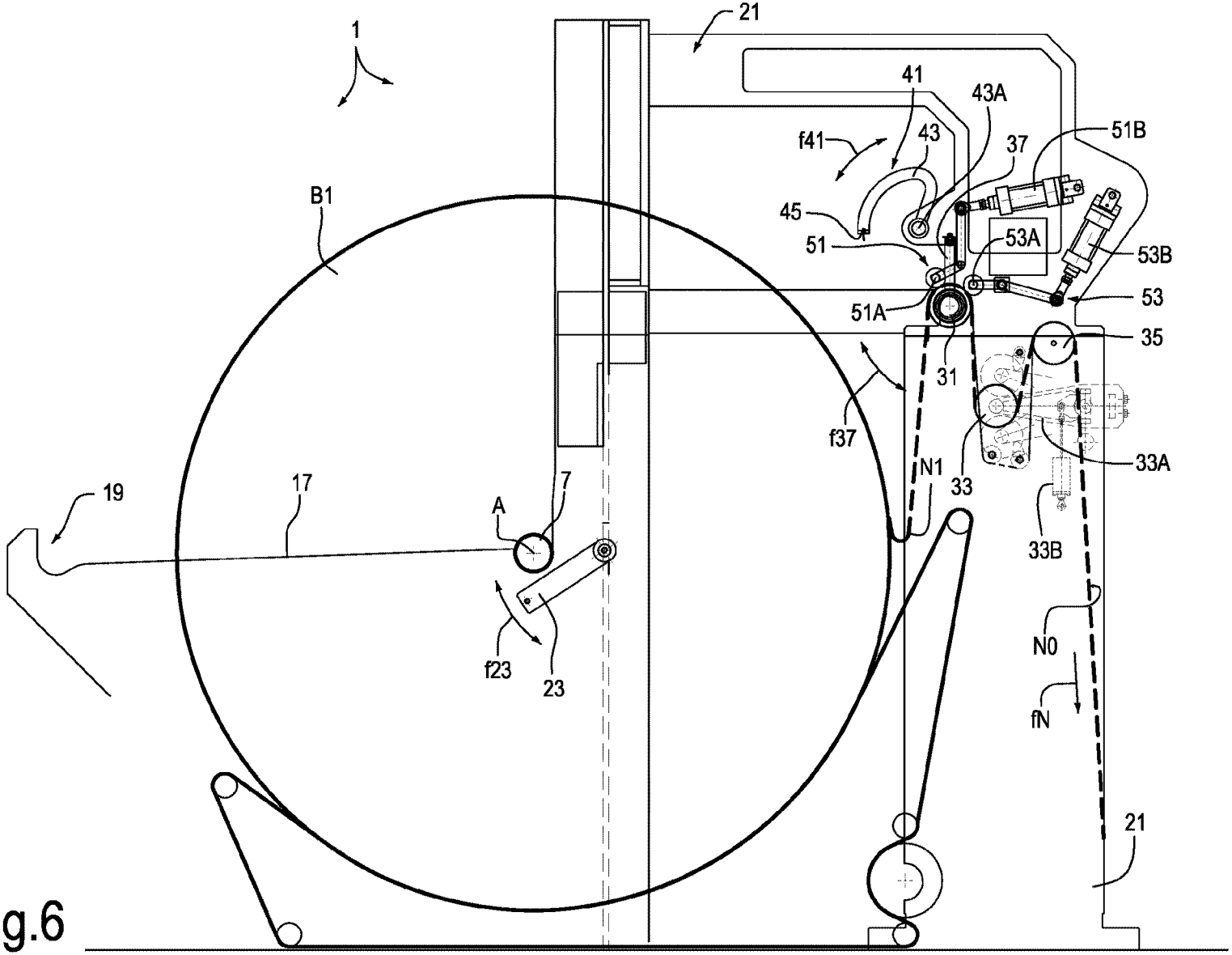
Figure 7:
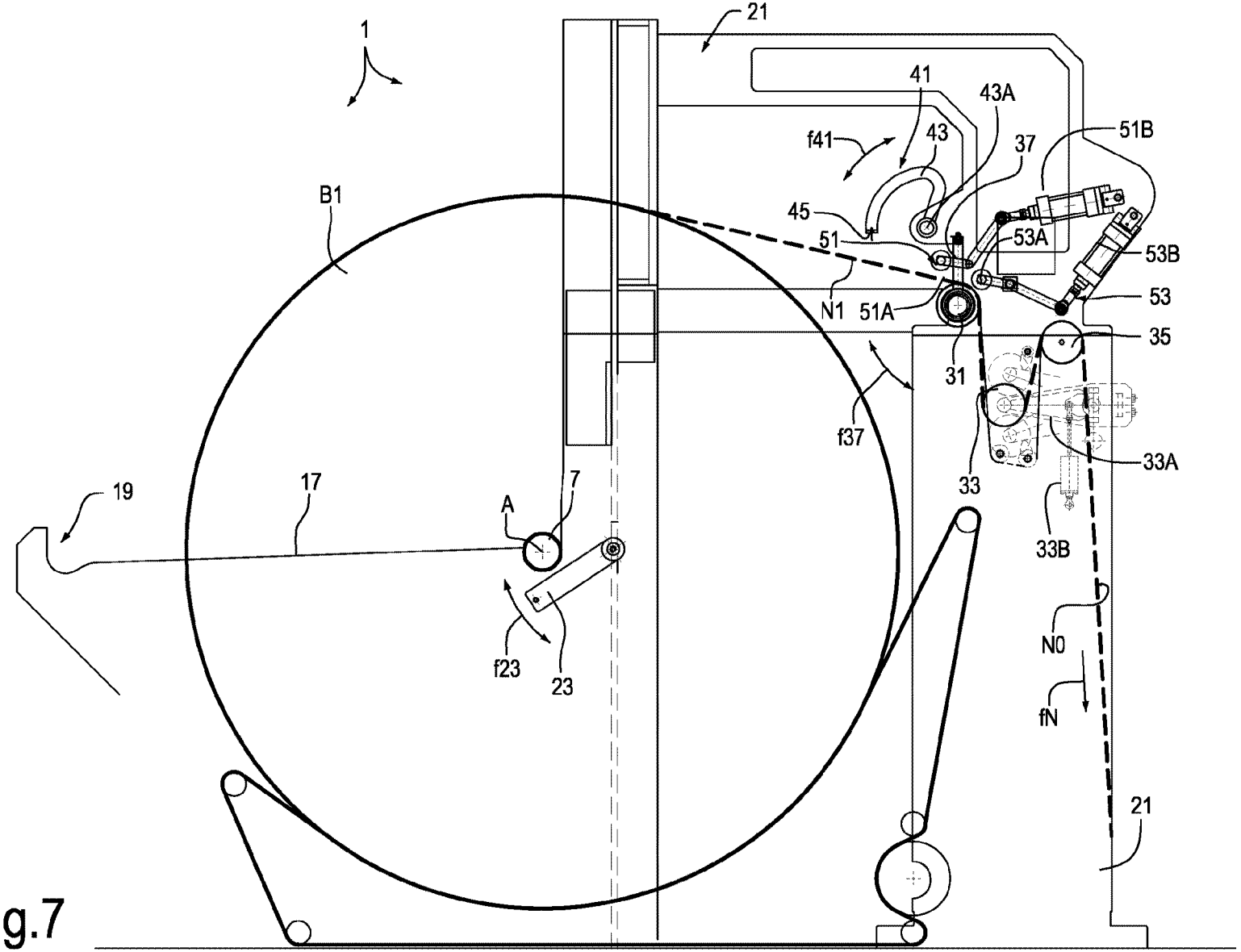

In the subsequent step, illustrated in FIG. 6, the ply-bonding wheels 51A of the pressing member 51 are lowered and retain the leading edge LT on the roller 31, so that the arched arms 43 of the pick-up device 41 can be rotated to the previous position, releasing the leading edge LT.

At this point, rotation of the reel B1 by means of unwinder members, not shown and of known type, can start up to begin feeding the web material N0, N1 toward the converting line, not shown, downstream of the unwinder 1. As in this step, during which the feed speed can be maintained particularly low, the ply-bonding wheels 51A and 53A press the web material against the roller 31, the leading edge LT and the trailing edge LC are spliced, ensuring continuity of feed of the web material. After splicing of the leading edge LT and the trailing edge LC, the rotation speed of the reel B1 and hence the feed speed of the web material can be gradually increased until reaching the operating speed.

By means of the double hooks 3, with simple movements of the bridge crane carrying said hooks, the new reel B1 can be easily unloaded into the unwinding station and the exhausted reel B0 can be picked up from the dwell and removal station 19, to move it away from the unwinder 1.

The invention claimed is:

1. An unwinder for unwinding reels of web material to be fed to a converting line, comprising an unwinding station, in which to arrange a reel to be unwound, wherein the unwinding station comprises:

a stationary structure;

a series of guide rollers, defining a feed path of the web material;

a cutting member adapted to cut web material coming from an exhausted reel;

splicing members to splice a trailing edge of a first web material coming from the exhausted reel to a leading edge of a second web material coming from a new reel;

a pick-up device associated with the stationary structure and adapted to pick up the leading edge of the second web material from a temporary retaining element, carried by a transfer unit adapted to transfer reels to the unwinding station;

wherein the transfer unit comprises a bridge crane with a pair of hooks configured to engage said reels, the bridge crane being movable with respect to the stationary structure of the unwinding station.

2. The unwinder of claim 1, wherein the transfer unit comprises an aerial transfer member.

3. The unwinder of claim 1, wherein each of said pair of hooks has two seats substantially symmetrical to each other with respect to a vertical plane parallel to an axis of a reel engaged with the hooks.

4. The unwinder of claim 1, wherein the temporary retaining element comprises a pair of arms extending from the transfer unit.

5. The unwinder of claim 4, wherein the temporary retaining element comprises a cross member extending approximately parallel to the axis of the reel engaged by the transfer unit and fixed to the pair of arms, said cross member having pick-up and temporary retaining members for the leading edge of a web material wound on a reel carried by said transfer unit.

6. The unwinder of claim 1, wherein the pick-up device comprises an arched arm hinged to the stationary structure of the unwinder and shaped so as to engage the leading edge of a web material of a reel carried by the transfer unit, said leading edge being temporarily retained by the temporary retaining element, and shaped to pass around the temporary retaining element.

7. The unwinder of claim 1, wherein the splicing members comprise at least one pressing member co-acting with a roller of said series of guide rollers.

8. The unwinder of claim 1, wherein the splicing members comprise a first pressing member adapted to retain the trailing edge of the first web material in the feed path and a second pressing member, adapted to press the leading edge of the second web material on the first web material.

9. The unwinder of claim 8, wherein the first pressing member and the second pressing member are configured and arranged to co-act with one of said guide rollers of said series of guide rollers, the first pressing member and the second pressing member being positioned on one side of the feed path and the guide roller with which the first pressing member and the second pressing member co-act being arranged on the other side of the feed path, said feed path extending orthogonally to an axis of said guide roller with which the first pressing member and the second pressing member co-act.

10. The unwinder of claim 8, wherein said first pressing member comprises a plurality of first ply-bonding wheels coaxial with one another.

11. The unwinder of claim 8, wherein said second pressing member comprises a plurality of second ply-bonding wheels coaxial with one another.

12. The unwinder of claim 1, wherein said cutting member, said splicing members and said pick-up device are controlled so that the pick-up device engages the leading edge of the second web material and transfers the leading edge from the temporary retaining element to the splicing members, which perform splicing of the leading edge of the second web material to the first web material after cutting of the first web material by the cutting member.

13. The unwinder of claim 1, comprising a dwell and removal station adapted to receive an exhausted reel from the unwinding station.

14. An unwinder for unwinding reels of web material to be fed to a converting line, comprising an unwinding station, in which to arrange a reel to be unwound and in which are arranged:

a series of guide rollers, defining a feed path of the web material;

a cutting member adapted to cut web material coming from an exhausted reel;

splicing members to splice a trailing edge of a first web material coming from the exhausted reel to a leading edge of a second web material coming from a new reel;

a pick-up device adapted to pick up the leading edge of the second web material from a temporary retaining element, carried by a transfer unit adapted to transfer reels to the unwinding station;

wherein the temporary retaining element comprises a pair of arms extending from the transfer unit; and wherein the temporary retaining element comprises a cross member extending approximately parallel to the axis of the reel engaged by the transfer unit and fixed to the pair of arms, said cross member having pick-up and temporary retaining members for the leading edge of a web material wound on a reel carried by said transfer unit.

15. The unwinder of claim 14, wherein the transfer unit comprises an aerial transfer member.

16. The unwinder of claim 14, wherein the transfer unit comprises a bridge crane with a pair of hooks configured to engage said reels.

17. The unwinder of claim 16, wherein each of said pair of hooks has two seats substantially symmetrical to each other with respect to a vertical plane parallel to an axis of a reel engaged with the hooks.

18. The unwinder of claim 14, wherein the splicing members comprise at least one pressing member co-acting with a roller of said series of guide rollers.

19. The unwinder of claim 14, wherein the splicing members comprise a first pressing member adapted to retain the trailing edge of the first web material in the feed path and a second pressing member, adapted to press the leading edge of the second web material on the first web material.

20. The unwinder of claim 19, wherein the first pressing member and the second pressing member are configured and arranged to co-act with one of said guide rollers of said series of guide rollers, the first pressing member and the second pressing member being positioned on one side of the feed path and the guide roller with which the first pressing member and the second pressing member co-act being arranged on the other side of the feed path, said feed path extending orthogonally to an axis of said guide roller with which the first pressing member and the second pressing member co-act.

21. The unwinder of claim 19, wherein said first pressing member comprises a plurality of first ply-bonding wheels coaxial with one another.

22. The unwinder of claim 19, wherein said second pressing member comprises a plurality of second ply-bonding wheels coaxial with one another.

23. The unwinder of claim 14, wherein said cutting member, said splicing members and said pick-up device are controlled so that the pick-up device engages the leading edge of the second web material and transfers the leading edge from the temporary retaining element to the splicing members, which perform splicing of the leading edge of the second web material to the first web material after cutting of the first web material by the cutting member.

24. The unwinder of claim 14, comprising a dwell and removal station adapted to receive an exhausted reel from the unwinding station.

25. An unwinder for unwinding reels of web material to be fed to a converting line, comprising an unwinding station, in which to arrange a reel to be unwound and in which are arranged:

a series of guide rollers, defining a feed path of the web material;

a cutting member adapted to cut web material coming from an exhausted reel;

splicing members to splice a trailing edge of a first web material coming from the exhausted reel to a leading edge of a second web material coming from a new reel;

a pick-up device adapted to pick up the leading edge of the second web material from a temporary retaining element, carried by a transfer unit adapted to transfer reels to the unwinding station;

wherein the pick-up device comprises an arched arm hinged to the stationary structure of the unwinder and shaped so as to engage the leading edge of a web material of a reel carried by the transfer unit, said leading edge being temporarily retained by the temporary retaining element, and shaped to pass around the temporary retaining element.

26. The unwinder of claim 25, wherein the transfer unit comprises an aerial transfer member.

27. The unwinder of claim 25, wherein the transfer unit comprises a bridge crane with a pair of hooks configured to engage said reels.

28. The unwinder of claim 27, wherein each of said pair of hooks has two seats substantially symmetrical to each other with respect to a vertical plane parallel to an axis of a reel engaged with the hooks.

29. The unwinder of claim 25, wherein the splicing members comprise at least one pressing member co-acting with a roller of said series of guide rollers.

30. The unwinder of claim 25, wherein the splicing members comprise a first pressing member adapted to retain the trailing edge of the first web material in the feed path and a second pressing member, adapted to press the leading edge of the second web material on the first web material.

31. The unwinder of claim 30, wherein the first pressing member and the second pressing member are configured and arranged to co-act with one of said guide rollers of said series of guide rollers, the first pressing member and the second pressing member being positioned on one side of the feed path and the guide roller with which the first pressing member and the second pressing member co-act being arranged on the other side of the feed path, said feed path extending orthogonally to an axis of said guide roller with which the first pressing member and the second pressing member co-act.

32. The unwinder of claim 30, wherein said first pressing member comprises a plurality of first ply-bonding wheels coaxial with one another.

33. The unwinder of claim 30, wherein said second pressing member comprises a plurality of second ply-bonding wheels coaxial with one another.

34. The unwinder of claim 25, wherein said cutting member, said splicing members and said pick-up device are controlled so that the pick-up device engages the leading edge of the second web material and transfers the leading edge from the temporary retaining element to the splicing members, which perform splicing of the leading edge of the second web material to the first web material after cutting of the first web material by the cutting member.

35. The unwinder of claim 25, comprising a dwell and removal station adapted to receive an exhausted reel from the unwinding station.

* * * * *